US008162044B2

(12) United States Patent
Sihler

(10) Patent No.: US 8,162,044 B2
(45) Date of Patent: Apr. 24, 2012

(54) SYSTEMS AND METHODS FOR PROVIDING ELECTRICAL TRANSMISSION IN DOWNHOLE TOOLS

(76) Inventor: Joachim Sihler, Gloucestershire (GB)

( * ) Notice: Subject to any disclaimer, the term of this patent is extended or adjusted under 35 U.S.C. 154(b) by 296 days.

(21) Appl. No.: 12/348,028

(22) Filed: Jan. 2, 2009

(65) Prior Publication Data

US 2010/0170671 A1 Jul. 8, 2010

(51) Int. Cl.
*E21B 43/00* (2006.01)
*H01R 39/00* (2006.01)

(52) U.S. Cl. ..... 166/65.1; 166/68; 166/105; 439/22; 417/53

(58) Field of Classification Search ..... 166/65.1, 166/68, 105; 175/315; 415/220; 439/20–22, 439/26–29; 417/53, 423.7
See application file for complete search history.

(56) References Cited

U.S. PATENT DOCUMENTS 2,889,531 A 6/1959 Ellerman et al.
2,978,600 A 4/1961 Silverman
3,727,167 A 4/1973 Tole et al.
4,909,741 A 3/1990 Schasteen et al.
5,468,153 A 11/1995 Brown et al.
6,000,915 A * 12/1999 Hartman ..... 417/356
6,089,875 A 7/2000 Iwata et al.
7,074,044 B2 7/2006 Billing et al.
7,253,745 B2 8/2007 Hall et al.
2008/0286131 A1 * 11/2008 Yuratich et al. ..... 417/410.1
2010/0064707 A1 * 3/2010 Sato et al. ..... 62/176.3

* cited by examiner

*Primary Examiner* — Kenneth L Thompson
*Assistant Examiner* — Yong-Suk Ro
(74) *Attorney, Agent, or Firm* — Jeremy P. Welch

(57) ABSTRACT

A downhole drilling tool includes a housing defining an axial passageway and a shaft mounted for rotation within the axial passageway such that the housing and shaft form an annular gap. An electrical connector provides a signal to the shaft. The electrical connector includes a first lead assembly coupled to the housing and the shaft, and a second lead assembly coupled to the housing and the shaft. Each lead assembly has an outer ring electrode fixed to the housing and an inner ring electrode fixed to the shaft for rotation therewith such that connector gaps are formed between the outer ring electrodes and the inner ring electrodes. Drilling fluid is pumped through the annular gap to flow through the connector gaps to complete electrical connections between the outer ring electrodes and inner ring electrodes.

20 Claims, 2 Drawing Sheets

SYSTEMS AND METHODS FOR PROVIDING ELECTRICAL TRANSMISSION IN DOWNHOLE TOOLS

BACKGROUND OF THE DISCLOSURE

1. Field of the Disclosure

The subject disclosure relates to systems and methods for oil and gas drill strings, and more particularly to improved systems and methods for providing contactless, low maintenance downhole electrical transmission.

2. Background of the Related Art

In drill strings, hundreds of sections of drill pipe and associated downhole tools are connected in series. Many of these components require electrical continuity to transmit power, signals, and/or data. However, providing electrical transmission to the components can be challenging because various components not only rotate independently but may even rotate continuously and/or at different speeds. For example, a mud motor typically has upper and lower portions that rotate at different speeds. For another example, common control units have a roll-stabilized platform kept geostationary while an associated collar rotates at drill bit speed.

If electrical connection is desired between such components, the electrical connections must be capable of conducting or transmitting electrical power, signals, and/or data between independently and even continuously rotating or otherwise moving structures. Further, downhole tools are operated under harsh conditions. Thus, the connections must be designed robustly to maintain reliability under mechanical stress, misalignment and abusive mishandling.

In view of the above, several approaches have been developed to provide electrical connections in drill strings. Commonly, slip rings with wiper rings are used to transmit signals across moving parts, see for example U.S. Pat. No. 7,074,044 issued on Jul. 11, 2006. Other approaches have utilized conductive rings paired with brushes affixed to electrode plates, see for example U.S. Pat. No. 6,089,875 issued Jul. 18, 2000. Still other approaches involve inductive coupling devices or the creation of oil environments with pressure compensators and rotating seals.

There are problems associated with the techniques of the prior art to accomplish electrical connections in drill strings. The prior art approaches are quite complex and require difficult maintenance. The complex nature tends to make the connections unreliable under the extraordinarily harsh conditions. Additionally, frequent and difficult maintenance makes the connections far less than economic. There is a need, therefore, for improved systems and methods which require minimal maintenance with a simple structure that assures effective electrical connections.

SUMMARY OF THE INVENTION

An object of the subject technology is to provide an electrical connection between a rotating structure and another structure that may be stationary or rotating in a downhole tool The subject technology provides a simple structure for accomplishing the electrical connections. The structure also requires little maintenance. The subject technology does not use brushes or other mechanical contact elements, pressure compensators, rotating seals, or inductive coupling devices with associated downhole driver electronics. Rather, the subject technology advantageously uses the drilling mud as a conductor and an insulator.

In one embodiment, the subject technology is directed to a method of providing an electrical connection to a rotating shaft in an axial passageway of a housing in a downhole tool.

The method includes the steps of forming an annular gap between the housing and rotating shaft, fixing a first outer ring electrode to the housing and a first inner ring electrode to the shaft for rotation therewith. The first outer ring electrode and the first inner ring electrode form a first connector gap in fluid communication with the annular gap. The method also includes the step of fixing a second outer ring electrode to the housing and a second inner ring electrode to the shaft for rotation therewith. The second outer ring electrode and the second inner ring electrode form a second connector gap in fluid communication with the annular gap. To complete the electrical connections, the method also pumps drilling fluid through the annular gap, the first connector gap and the second connector gap.

The first inner and outer ring electrodes may be axially spaced from the second inner and outer ring electrodes to reduce a leak current therebetween. The method may add at least one additive to the drilling mud to set an electrical resistivity thereof. Preferably, the housing and the rotating shaft are electrically insulated or fabricated from electrically insulating material. The method may also include bi-directionally transmitting a signal across the first and second connector gaps. The method may also utilize the first and second outer ring electrodes to support shaft for rotation.

Still another embodiment of the subject technology includes a downhole drilling tool having a housing defining an axial passageway and a shaft mounted for rotation within the axial passageway such that the housing and shaft form an annular gap. An electrical connector provides a signal to the shaft. The electrical connector includes a first lead assembly coupled to the housing and the shaft, and a second lead assembly coupled to the housing and the shaft. Each lead assembly has an outer ring electrode fixed to the housing and an inner ring electrode fixed to the shaft for rotation therewith such that connector gaps are formed between the outer ring electrodes and the inner ring electrodes. Drilling fluid is pumped through the annular gap to flow through the connector gaps to complete electrical connections between the outer ring electrodes and inner ring electrodes.

Preferably, the first lead assembly is axially spaced from the second lead assembly to reduce a leak current therebetween. Any source, controller or processing device may bi-directional create and transmit signals to a load, sensors and the like. To enhance performance, an elastic seal may be provided between the first and second connector gaps. Additionally, the drilling fluid may be a water based drilling fluid, an oil based drilling fluid, a drilling fluid that is preconditioned for use in power transmission, and combinations thereof.

In another embodiment, the subject technology is directed to a positive displacement pump in a downhole drill string having a housing that defines an axial passageway. A stator/rotor assembly is mounted in the axial passageway, wherein the stator/rotor assembly and the housing form an annular gap. The stator/rotor assembly includes a shaft, a stator for inducing a swirl in drilling fluid, and a rotor that rotates in response to the swirled drilling fluid to drive the shaft. The shaft defines a central electrical conduit. An electrical connector provides signals bi-directionally to the stator/rotor assembly. The electrical connector has first and second lead assemblies coupled to the stator/rotor assembly. Each lead assembly has an outer ring electrode fixed to the housing and an inner ring electrode fixed to the stator/rotor assembly for rotation therewith such that connector gaps are formed between the outer ring electrodes and the inner ring electrodes. Stationary wires electrically connect to the outer ring electrodes and rotating wires, in the central electrical conduit, connect to the inner ring electrodes. Drilling fluid is pumped through the annular gap and the connector gaps to complete electrical connections between the stationary wires and the rotating wires as well as drive the rotor.

It should be appreciated that the present invention can be implemented and utilized in numerous ways, including without limitation as a process, an apparatus, a system, a device, and methods for applications now known and later developed. These and other unique features of the technology disclosed herein will become more readily apparent from the following description and the accompanying drawings.

BRIEF DESCRIPTION OF THE DRAWINGS

So that those having ordinary skill in the art to which the disclosed systems and methods appertain will more readily understand how to make and use the same, reference may be had to the drawings wherein.

DETAILED DESCRIPTION OF PREFERRED EMBODIMENTS

Figure 1:
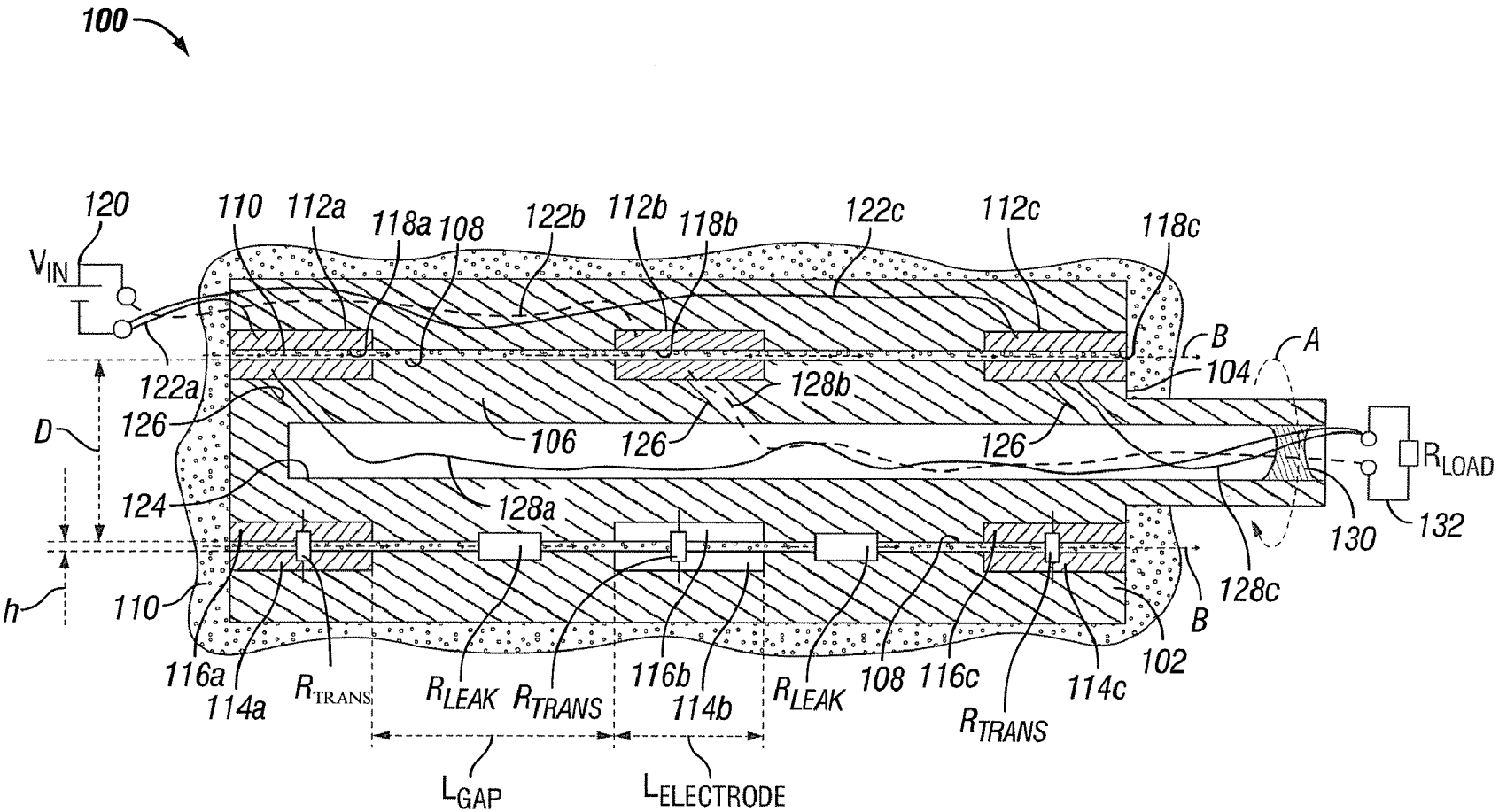
FIG. 1 is an enlarged localized cross-sectional view of a downhole drilling tool with contactless electrical transmission in accordance with the subject technology.

The present disclosure overcomes many of the prior art problems associated with transmitting electrical signals between downhole components. The advantages, and other features of the systems and methods disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

All relative descriptions herein such as top, bottom, left, right, up, and down are with reference to the Figures, and not meant in a limiting sense. The illustrated embodiments can be understood as providing exemplary features of varying detail of certain embodiments, and therefore, features, components, modules, elements, and/or aspects of the illustrations can be otherwise combined, interconnected, sequenced, separated, interchanged, positioned, and/or rearranged without materially departing from the disclosed systems or methods. Additionally, the shapes and sizes of components are also exemplary and unless otherwise specified, can be altered and still be within the scope of the disclosed technology.

In brief overview, the subject technology provides electrical connection between a rotating and a stationary or independently rotating structure in a downhole tool. Relatively thin and long gaps are established between the structures and drilling mud is allowed to flow into the gaps. The gaps are sized and the resistivity of the drilling mud is set such that the transmission across the gaps is acceptable and the leakage current across the drilling mud between the electrical contacts is negligible. Thus, the drilling mud can serve the dual purpose of acting as a conductor and an insulator.

Referring now to FIG. 1, an enlarged localized cross-sectional view of a downhole drilling tool 100 with contactless electrical transmission in accordance with the subject technology is shown. The downhole drilling tool 100 includes a stationary housing 102 that defines an axial passageway 104. The housing 102 may include electrical insulation or simply be fabricated from an electrically insulative material such as plastic.

A shaft 106 is mounted within the axial passageway 104 for rotation as denoted by arrow "A". Similar to the housing 102, the shaft 106 may also include electrical insulation or simply be fabricated from an electrically insulative material. The housing 102 and the shaft 106 form an elongated annular gap 108 through which drilling fluid or mud 110 flows. The flow of drilling fluid 110 through the annular gap 108 is denoted by arrows "B". At various points in the elongated annular gap 108, there are lead or connector assemblies 112*a-c*. The connector assemblies 112*a-c* provide contactless electrical transmission from the housing 102 to the shaft 106.

Each connector assembly 112*a-c* has an outer ring electrode 114*a-c* fixed to the housing 102 and an inner ring electrode 116*a-c* fixed to the shaft 106. The outer ring electrodes 114 are stationary and the inner ring electrodes 116 rotate with the shaft 106. The outer ring electrodes 114*a-c* and the inner ring electrodes 116*a-c* are sized and configured such that connector gaps 118*a-c*, respectively, are formed therebetween. The connector gaps 118 are in fluid communication with the elongated annular gap 108 generally formed between the housing 102 and the shaft 106. In other words, the connector gaps 118 are aligned with the annular gap 108. In one embodiment, the outer and inner electrodes 114, 116 serve as radial bearing for the shaft 106.

An electrical source 120 provides power to a load 132 via the connector assemblies 112*a-c*. Stationary wires 122*a-c* extend from the power source 120 to the outer ring electrodes 114*a-c*. In an embodiment with a DC power source 120, the stationary wires 122*a*, 122*c* connect outer ring electrodes 114*a*, 114*c* to the negative lead (not shown explicitly) of the power source 120, thus the connector assemblies 112*a*, 112*c* are negative poles. In contrast, the other stationary wire 122*b* connects the outer ring electrode 114*b* to the positive lead (not shown explicitly) of the power source 120, thus the connector assembly 114*b* is a positive pole. Of course, the power source 120 may be AC or not a power source at all but a device such as a controller for transmitting any signal to and/or receiving data and other signals from the shaft 106. In any case, the drilling mud 110 flows through the connector gaps 118 to complete the electrical connections between the outer ring electrodes 114*a-c* and the inner ring electrodes 116*a-c*.

The shaft 106 also forms an electrical conduit 124 that is preferably substantially centrally located. The electrical conduit 124 also forms a passage 126*a-c* to each inner ring electrode 116*a-c*. Additional wires 128*a-c* in the electrical conduit 124 connect to each inner ring electrode 116*a-c* for bi-directionally carrying electrical signals. Thus, the additional wires 128*a-c* rotate with the shaft 106. The rotating wires 128*a-c* may electrically connect to or simply pass through a traditional threaded connector 130 at the lower or right end of the shaft 106 to allow the electrical signals to pass to the load 132. The load 132 may be one or more sensors near a bit (not shown) that are powered by the rotating wires 128 and feed information back along the same path for ultimate delivery to the surface by wired drill pipe, mud telemetry and the like. The sensors may also provide feedback control for actuators near the bit. The actuators may also being powered by signals passing through the electrodes 114*a-c*, 116*a-c*. Commonly used sensors monitor vibration, temperature, speed, and Weight on bit as well as evaluate formation parameters such as porosity, density and the like.

Still referring to FIG. 1, electrical resistances $R_{leak}$, $R_{trans}$ are schematically represented on the bottom of the drilling tool 100 to help illustrate operation of the subject technology.

If the housing 102 and the shaft 106 are properly electrically insulated, the leakage current flowing axially from positive to negative or "ground" can only flow through the drilling mud 110 in the annular gap 108 between the connector assemblies 112*a-c*. As a result, the electrical loss resistance $R_{leak}$ of the leak current can be represented as follows:

$$R_{leak}=\rho_{mud}*L_{gap}/A_{gap} \quad \text{(Equation 1)}$$

where $\rho_{mud}$ is the electrical resistivity of the drilling mud 110, $A_{gap}$ is the cross-sectional area of the annular gap 108, and the $L_{gap}$ (shown in FIG. 1) is a length or distance between the connector assemblies 112*a-c*.

Due to the conductance of the drilling mud 110, there is also a useful or signal current flowing radially through the connector assemblies 112*a-c* from the outer electrodes 114*a-c* to the respective inner electrodes 116*a-c*. The signal current flows perpendicularly to the connector gaps 118*a-c*. The electrical signal resistance $R_{trans}$ of the signal current can be represented as follows:

$$R_{trans}=\rho_{mud}*h/A_{electrode} \quad \text{(Equation 1)}$$

where h is a height of the connector gap 108 and $A_{electrode}$ is the cross-sectional area of the connector gap 108. As would be appreciated by those of ordinary skill in the pertinent art, the resistances $R_{trans}$, $R_{leak}$ are functions of the shaft diameter D. As such, $A_{gap}$ is equal to πDh and $A_{electrode}$ is equal to $\pi DL_{electrode}$, wherein $L_{electrode}$ (shown in FIG. 1) is a length of the electrodes 114*a-c*, 116*a-c* of the connector assemblies 112*a-c*.

Figure 2:
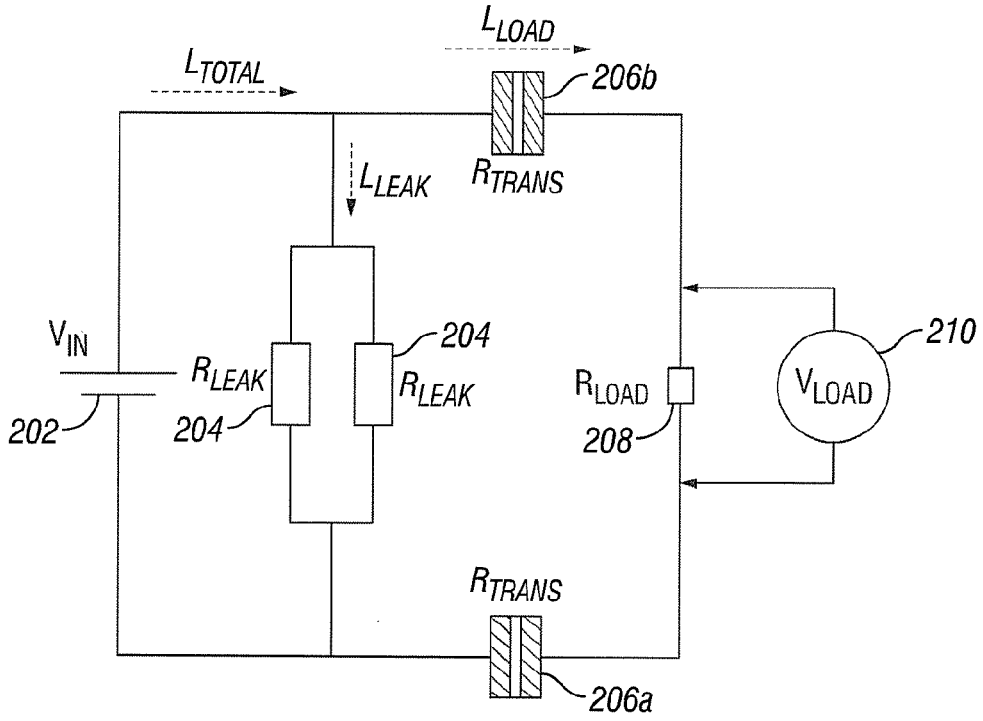
FIG. 2 is an electrical circuit representing the physical parameters of the contactless electrical transmission of FIG. 1.

Referring additionally to FIG. 2, an electrical circuit 200 representing the physical parameters of the drilling tool 100 of FIG. 1 is shown. The representative electrical circuit 200 is useful for calculating various parameters and would be modified to match various hardware configurations that use the subject technology. The electrical circuit 200 has labeled arrows indicating the current flowing there through. The electrical circuit 200 includes a power supply 202 connected in parallel with the leakage resistance 204. The leakage resistance 204 is denoted by two parallel resistors $R_{leak}$ because, as can be seen from FIG. 1, leakage current $I_{leak}$ flows from the connector assembly 112*b* to both connector assemblies 112*a*, 112*c*, Thus, the total leakage resistance $R_{leak,\ total}$ may be represented as follows:

$$R_{leak,\ total}=\tfrac{1}{2}*R_{leak}=\tfrac{1}{2}*\rho_{mud}*L_{gap}/A_{gap}$$

As a result, the leakage current $I_{leak}$ is $$I_{leak}=V_{in}/R_{leak,\ total}$$

The negative connector gaps 118*a*, 118*c* and the positive connector gap 108*b* are also represented by resistors 206*a*, 206*b*, respectively. These transmission resistors 206*a*, 206*b* are connected in series with the load resistance 208, which is, in turn, represented as in parallel with the working load 210. Assuming that the connector gap resistances 206*a*, 206*b* are approximately the same, the useful or transmitted current $I_{load}$ through the transmission resistors 206*a*, 206*b* is represented as follows:

$$I_{load}=V_{in}/(2*R_{trans}+R_{load})$$

The transmission resistances 206*a*, 206*b* between the electrodes 114, 116 causes the voltage across the load 210 to drop to a value that is less than the input power supply voltage $V_{in}$. However, the parameters can be determined such that the voltage drop is acceptable even to downhole tools. For example, an electrical tool bus voltage cannot drop below 26V from a nominal 30V supply, otherwise the associated tool may not power up.

In one embodiment, the parameters have the following values:

D=0.04 m h=0.0001 m $L_{gap}$=0.1 m $L_{electrode}$=0.1 m $\rho_{mud}$=20 Ω/m (typical for tap water, the drilling mud may be conditioned)

$V_{in}$=30V (a standard nominal low-power tool bus voltage)

$R_{load}$=10 Ω/m

Thus, the following values are obtained in SI units:

$$R_{leak\underline{total}}=0.5*20*0.1/(\pi*0.04*0.0001)=80\ \text{k}\Omega$$

$$R_{trans}=20*0.0001/(\pi*0.04*0.1)=0.16\ \text{k}\Omega$$

where it is noted that there are two potential leak pathways, one to each side connector assembly 112*a*, 112*c* from the connector assembly 112*b*, thus a 0.5 factor is included in the formula above. As can be seen, the ratio between the leak resistance $R_{leak}$ and the transmission resistance $R_{trans}$ is very favorable. To continue, the leak current $I_{leak}$ and the transmission current $I_{trans}$ may be calculated as follows:

$$I_{leak}=30/8000=0.4\ \text{mA}$$

$$I_{trans}=30/(2*0.16+10)=2.91\ \text{A}$$

and the voltage $V_{load}$ across the load (i.e., the power consuming tool) is:

$$V_{load}=R_{load}*I_{trans}=10*2.91=29.1\text{V}$$

which is greater than the 26V minimally desired for many downhole application. Based on this performance, the power transmission efficiency μ is equal to the output power $P_{out}$ divided by the input power $P_{in}$ as follows:

$$\mu=P_{out}/P_{in}=(29.1*2.91)/(30*(2.91+0.0004))=96.9\%$$

which is a very high power transmission efficiency.

In view of the above, the subject technology has a wide variety of applications and advantages in the field of downhole drilling among other fields. For example, the connector assembly design easily accomodates axial movements of the shaft with respect to the housing. Thus, the connector assemblies are particularly well-suited for making an electrical connection to the rotor of a mud motor through a flexible shaft. Generally, the subject technology can be used in any drilling mud environment.

The drilling mud may be water based or oil based. If the initial resistivity is undesirable, the drilling mud may be conditioned to a desired resistivity value. It is envisioned that the conditioners and additives normally placed in the drilling mud for other purposes may accomplish providing the desired ionic carriers. If not, salts, minerals and the like can be added to modify the electrical conductivity.

While surface corrosion of the ring electrodes may be a concern, there are many acceptable solutions available to solve this erosion problem. Sacrifical anode and cathode methods may be used to prevent corrosion and ensure the functional integrity of the ring electrodes. For another example, see U.S. Pat. No. 7,253,745 issued On Aug. 7, 2007 to Hall et al.

Although the description of FIG. 1 is with respect to positive and negative electrodes, such as would be expected with DC voltage and current, it is envisioned that the subject technology would work well with AC signals. Further, two negative connector assemblies surrounding a single positive is just an exemplary version as any and all combinations, including repeating combinations, are envisioned. In the event that the leak current in a situation may be too high, the connector assemblies could be axially spaced farther apart to reduce a leak current therebetween.

The power source is also shown as such for illustrative purposes. Alternatively, the source connected to the electrical connectors may be a data source or data processor such as a controller (e.g., special purpose computer) and the like. The signal may be a power signal of approximately 200 Watts, a power signal of approximately 4-8 Amps, a data signal, and combinations thereof. The signal may also be transmitted bi-directionally across the electrical connectors. Additionally, the load connected to the electrical connectors may be motors, sensors, combinations of motors and sensors, and the like. The power may even be consumed by a component coupled to rotate with the shaft or another structure.

It is also envisioned that the connector assemblies 112*a-c* may serve as radial bearings for the shaft 106. As the connector gaps 118*a-c* may be relatively tight, the connector assemblies 112*a-c* may be robustly configured to support the weight and force of the shaft 106. Further, the presence of the drilling mud 110 in the connector gaps 118*a-c* will effectively act as a lubricant for the bearing. Additional gaps, whether or not electrically necessary, can be included to provide sufficient surface area for the anticipated load of the shaft. In another embodiment, the connector gaps include an elastic seal or elastomer insert that at least partially fills the gaps. The elastic seals can even completely fill the connector gaps, e.g., set a zero gap and/or create seal lines.

In another embodiment, the subject technology is utilized in the power section or mud motor of a drill string. The subject technology can overcome difficulties associated with getting signals, power, and data across the mud motor as the signals, power, and data pass between the top sub and drill bit. As the stator can often be quite long, e.g., greater than 20 feet, going around the mud motor is difficult. The subject technology allows passing the signals, power, and data centrally through the shaft of the mud motor.

One such mud motor or positive displacement pump has a housing that defines an axial passageway. A stator/rotor assembly is mounted in the axial passageway, wherein the stator/rotor assembly and the housing form an annular gap. The stator/rotor assembly includes a shaft, a stator for inducing a swirl in drilling fluid, and a rotor that rotates in response to the swirled drilling fluid to drive the shaft. The shaft defines a central electrical conduit. An electrical connector provides signals bi-directionally to the stator/rotor assembly. The electrical connector has first and second lead assemblies coupled to the stator/rotor assembly. Each lead assembly has an outer ring electrode fixed to the housing and an inner ring electrode fixed to the stator/rotor assembly for rotation therewith such that connector gaps are formed between the outer ring electrodes and the inner ring electrodes. Stationary wires electrically connect to the outer ring electrodes and rotating wires, in the central electrical conduit, connect to the inner ring electrodes. Drilling fluid is pumped through the annular gap and the connector gaps to complete electrical connections between the stationary wires and the rotating wires as well as drive the rotor.

INCORPORATION BY REFERENCE

All patents, published patent applications and other references disclosed herein are hereby expressly incorporated in their entireties by reference.

While the invention has been described with respect to preferred embodiments, those skilled in the art will readily appreciate that various changes and/or modifications can be made to the invention without departing from the spirit or scope of the invention as defined by the appended claims. For example, each claim may depend from any or all claims in a multiple dependent manner even though such has not been originally claimed.

What is claimed is:

1. A method of providing an electrical connection to a rotating shaft in an axial passageway of a housing in a downhole tool, the method comprising the steps of:

a) forming an annular gap between the housing and rotating shaft;

b) fixing a first outer ring electrode to the housing and a first inner ring electrode to the shaft for rotation therewith, wherein the first outer ring electrode and the first inner ring electrode form a first connector gap in fluid communication with the annular gap;

c) fixing a second outer ring electrode to the housing and a second inner ring electrode to the shaft for rotation therewith, wherein the second outer ring electrode and the second inner ring electrode form a second connector gap in fluid communication with the annular gap; and d) pumping drilling fluid through the annular gap, the first connector gap and the second connector gap.

2. A method as recited in claim 1, further comprising the step of axially spacing the first inner and outer ring electrodes from the second inner and outer ring electrodes to reduce a leak current therebetween.

3. A method as recited in claim 1, further comprising the step of connecting wires to electrodes for transmitting an electrical signal to and from the electrodes.

4. A method as recited in claim 1, further comprising the step of connecting a power source to the first and second outer ring electrodes.

5. A method as recited in claim 1, further comprising the step of connecting a load to the first and second inner ring electrodes.

6. A method as recited in claim 1, wherein the housing and the rotating shaft are fabricated from electrically insulating material.

7. A method as recited in claim 1, further comprising the step of transmitting a signal across the first and second connector gaps.

8. A method as recited in claim 7, wherein the signal is selected from a power signal of approximately 200 Watts, a power signal of approximately 4-8 Amps, a data signal, and combinations thereof.

9. A method as recited in claim 7, wherein the signal is transmitted bi-directionally.

10. A method as recited in claim 1, further comprising the step of allowing axial movements between a rotor and a stator associated with the shaft in the downhole tool while transmitting a signal across the first and second connector gaps.

11. A method as recited in claim 1, further comprising the step of at least partially supporting the shaft for rotation with the first and second outer ring electrodes.

12. A downhole drilling tool comprising:

a) a housing defining an axial passageway;

b) a shaft mounted for rotation within the axial passageway, wherein the housing and shaft form an annular gap;

c) an electrical connector for providing a signal to the shaft including: i) a first lead assembly coupled to the housing and the shaft; and ii) a second lead assembly coupled to the housing and the shaft, wherein each lead assembly has an outer ring electrode fixed to the housing and an inner ring electrode fixed to the shaft for rotation therewith such that connector gaps are formed between the outer ring electrodes and the inner ring electrodes; and d) drilling fluid pumped through the annular gap to flow through the connector gaps to complete electrical connections between the outer ring electrodes and the inner ring electrodes.

13. A downhole drilling tool as recited in claim 12, wherein the first lead assembly is axially spaced from the second lead assembly to reduce a leak current therebetween.

14. A downhole drilling tool as recited in claim 12, further comprising:

a signal source connected to the electrical connector, wherein the source is selected from the group consisting of a power source, a data source and combinations thereof; and a load connected to the electrical connector, wherein the load is selected from the group consisting of a tool, an actuator, a sensor and combinations thereof.

15. A downhole drilling tool as recited in claim 12, wherein the housing and the shaft are fabricated from electrically insulating material.

16. A downhole drilling tool as recited in claim 12, further comprising an elastic seal at least partially filling the first and second connector gaps.

17. A downhole drilling tool as recited in claim 12, wherein the first and second lead assemblies serve as at least a portion of a radial bearing for the shaft.

18. A downhole drilling tool as recited in claim 17, further comprising additional bearing gaps to provide surface area for an anticipated load of the shaft.

19. A downhole drilling tool as recited in claim 12, wherein the drilling fluid is selected from the group consisting of a water based drilling fluid, an oil based drilling fluid, a drilling fluid that is preconditioned for use in power transmission, and combinations thereof.

20. A positive displacement pump in a downhole drill string comprising:

a) a housing defining an axial passageway;

b) a stator/rotor assembly mounted in the axial passageway, wherein the stator/rotor assembly and the housing form an annular gap, the stator/rotor assembly including a shaft, a stator for inducing a swirl in drilling fluid, and a rotor that rotates in response to the swirled drilling fluid to drive the shaft, wherein the shaft defines a central electrical conduit;

c) an electrical connector for providing a signal to the stator/rotor assembly including: first and second lead assemblies coupled to the stator/rotor assembly, wherein each lead assembly has an outer ring electrode fixed to the housing and an inner ring electrode fixed to the stator/rotor assembly for rotation therewith such that connector gaps are formed between the outer ring electrodes and the inner ring electrodes; stationary wires electrically connected to the outer ring electrodes; and rotating wires in the central electrical conduit and connected to the inner ring electrodes; and d) drilling fluid pumped through the annular gap and the connector gaps to complete electrical connections between the stationary wires and the rotating wires as well as drive the rotor.

* * * * *